US006340284B1

(12) United States Patent
Beeck et al.

(10) Patent No.: US 6,340,284 B1
(45) Date of Patent: Jan. 22, 2002

(54) TURBINE BLADE WITH ACTIVELY COOLED SHROUD-BAND ELEMENT

(75) Inventors: Alexander Beeck, Kussaberg (DE); Ibrahim El-Nashar, Kloten; Beat Von Arx, Trimbach, both of (CH); Bernhard Weigand, Filderstadt-Sielmingen (DE)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/471,410

(22) Filed: Dec. 23, 1999

(30) Foreign Application Priority Data

Dec. 24, 1998 (DE) ..... 198 60 244
Dec. 24, 1998 (DE) ..... 198 60 245

(51) Int. Cl.[7] ..... F01D 5/18

(52) U.S. Cl. ..... 415/115; 415/173.1; 415/173.5; 416/92; 416/97 R; 416/189; 416/191; 416/192

(58) Field of Search ..... 416/92, 96 R, 416/96 A, 97 R, 189, 191, 192; 415/115, 116, 730.1, 730.5

(56) References Cited

U.S. PATENT DOCUMENTS

| | | | | | |
|---|---|---|---|---|---|
| 3,527,544 | A | * | 9/1970 | Allen | 416/97 R |
| 3,816,022 | A | * | 6/1974 | Day | 416/92 |
| 4,177,011 | A | | 12/1979 | Eskesen et al. | |
| 4,940,388 | A | * | 7/1990 | Lilleker et al. | 416/97 R |
| 4,948,338 | A | * | 8/1990 | Wickerson | 416/92 |
| 5,306,401 | A | | 4/1994 | Fierkens et al. | |
| 5,399,065 | A | | 3/1995 | Kudo et al. | |
| 5,460,486 | A | | 10/1995 | Evans et al. | |
| 5,482,435 | A | | 1/1996 | Dorris et al. | |
| 5,785,496 | A | | 7/1998 | Tomita | |
| 6,146,098 | A | * | 11/2000 | Fukuno et al. | 416/97 R |
| 6,152,695 | A | * | 11/2000 | Fukue et al. | 416/97 R |

FOREIGN PATENT DOCUMENTS

| | | | | |
|---|---|---|---|---|
| DE | 2319743 | | 10/1973 | |
| DE | 2343639 | | 3/1974 | |
| DE | 19813173 | | 10/1998 | |
| GB | 1605335 | | 12/1991 | |
| GB | 2290833 | | 1/1996 | |
| JP | 58-47104 | * | 3/1983 | 416/189 |
| JP | 3-182602 | * | 8/1991 | 416/97 R |

* cited by examiner

*Primary Examiner*—Christopher Verdier
(74) *Attorney, Agent, or Firm*—Burns, Doane, Swecker & Mathis, L.P.P.

(57) ABSTRACT

In an air-cooled turbine blade which, at the blade tip, has a shroud-band element extending transversely to the longitudinal axis of the blade, a plurality of cooling bores passing through the shroud-band element for the purpose of cooling, which cooling bores are connected on the inlet side to at least one cooling-air passage running through the turbine blade to the blade tip and open on the outlet side into the exterior space surrounding the turbine blade, improved and assured cooling is achieved owing to the fact that the cooling bores run from inside to outside in the shroud-band element at least approximately parallel to the direction of movement of the blade and in each case open upstream of the outer margin of the shroud-band element into a surface recess open toward the exterior space. The top side of the shroud band is preferable provided with at least two ribs and, which run in parallel and, in interaction with the opposite casing wall, form a cavity, into which the cooling air discharging from the cooling bores flows.

13 Claims, 5 Drawing Sheets

TURBINE BLADE WITH ACTIVELY COOLED SHROUD-BAND ELEMENT

FIELD OF THE INVENTION

The present invention relates to the field of gas turbines, and more particularly to air-cooled turbine blades

BACKGROUND OF THE INVENTION

Modern gas turbines work at extremely high temperatures. This requires intensive cooling of the turbine blades. A particular difficulty is to reliably cool the exposed regions of the blades. One of these regions is the shroud band or the -shroud-band elements of the blade. German Patent No. DE 198 13 173 A1 or U.S. Pat. No. 5,785,496 disclose turbine blades of this general type. One possibility of cooling shroud-band elements has been described in the publication DE 198 13 173 A1 mentioned at the beginning. In this publication, it is proposed (see FIGS. 3 and 4 there) to cool the shroud-band elements by a number of parallel cooling bores, which extend from the (central) moving blade through the shroud-band element to the outer edge of the shroud-band element and open there into the exterior space.

However, this known solution has the following disadvantages:

- Laterally abutting joints between two shroud-band elements of adjacent blades (as can be seen, for example, from FIG. 3 of U.S. Pat. No. 5,482,435) will at least partly close the orifices of the cooling bores. This hinders cooling-air discharge and distribution. The shroud-band element is overheated in operation,
- The known shroud-band cooling, on account of the laterally arranged orifices, does not change the conditions of flow over the shroud band; that is to say that the pressure and temperature on the top side of the shroud band remain the same. This is also not changed by the fact that, as proposed in U.S. Pat. No. 5,460,486, certain cooling bores open on the underside of the shroud-band element.
- The cooling effect is mainly based on the mixing temperature in the shroud-band surroundings, the mixing temperature being lowered by mixing of the discharging cooling air with the hot gas. No measures are taken in the cooling bores in order to intensify the heat transfer between the cooling air and the shroud-band element.

SUMMARY OF THE INVENTION

The object of the invention is therefore to provide a turbine blade having an air-cooled shroud-band element, in which turbine blade the abovementioned disadvantages are avoided in a simple manner and which is distinguished by effective cooling of the shroud-band element, in particular on the exposed top side of the shroud-band element.

This object is achieved by this invention.

The basic idea of the invention consists, on the one hand, in directing the cooling bores through the shroud-band element in such a way that considerable heat transfer between the shroud-band element and cooling air is ensured and, on the other hand, in making these bores open into the exterior space in such a way that the cooling air is reliably admitted to the exposed regions of the shroud band and these regions are additionally cooled. This is achieved by virtue of the fact that, starting from the cooling passage in the blade, the cooling bores, in the region of the shroud-band element, run from inside to outside essentially parallel to the direction of movement of the blade tip and in each case open upstream of the outer margin of the shroud-bank element into a surface recess open toward the exterior space.

In this case, in a first preferred embodiment of the invention, recesses, into which the cooling bores open laterally are sunk in the shroud-band element close to the outer margin from the top side. Due to the discharging cooling air mixing with the hot combustion gases which flow over the top side of the shroud-band element, the temperature in this region is effectively reduced and thus overheating of the shroud band is avoided. In this way, uniform cooling of the shroud-band element over the entire surface is achieved. In addition to effective cooling of the top side of the shroud band, this configuration also has the advantage of very simple manufacture. The discharge of the cooling air on the top side of the shroud-band element is especially effective if, in a preferred development, spaced-apart sealing ribs running parallel to one another are provided on the top side of the shroud-band element and form a cavity in interaction with the opposite casing wall of the gas turbine, and the cooling bores open into this cavity. The discharging cooling air leads to a pressure build-up in the cavity, the result of which is that the penetration of hot gases is reduced.

In another embodiment of the invention, the side edges of the shroud-band elements have recessed portions, into which the cooling bores open. In this case, the recessed portions of opposite shroud-band elements form a gap. During the discharge into the gap, the cooling air splits up into two partial flows. One part flows toward the top side and has the above mentioned effect on the above mentioned cavity between the space-apart sealing ribs. The other part flows toward the underside of the shroud bank and mixes there with the hot gases while setting a mixing temperature which reduces the thermal loading in this region. The ratio of the partial quantities flowing off upward and downward can be influenced by the gap geometry.

In an expedient addition to the invention, it is also proposed that means for improving the heat transfer between cooling air and shroud-band element be provided in the cooling bores. The means for improving the heat transfer at the bore walls may comprise roughness features, ribs and/or turbulence points. In a manner known per se, the bores may be produced by means of the so-called STEM drilling process. Cooling bores having improved heat-transfer properties can be produced in a simple and reliable manner especially by STEM drilling, which has been described, for example, in U.S. Pat. No. 5,306,401 in connection with the production of cooling holes in turbine blades.

Furthermore, improved utilization of the cooling air can be achieved if, in another preferred embodiment of the invention, a choke point for limiting the cooling-air mass flow is provided in each of the cooling bores, and the choke points are each arranged on the inlet side of the cooling bores.

BRIEF DESCRIPTION OF THE DRAWINGS

The invention is to be explained in more detail below with reference to exemplary embodiments and in connection with the drawing, in which.

DETAILED DESCRIPTION

Figure 1:
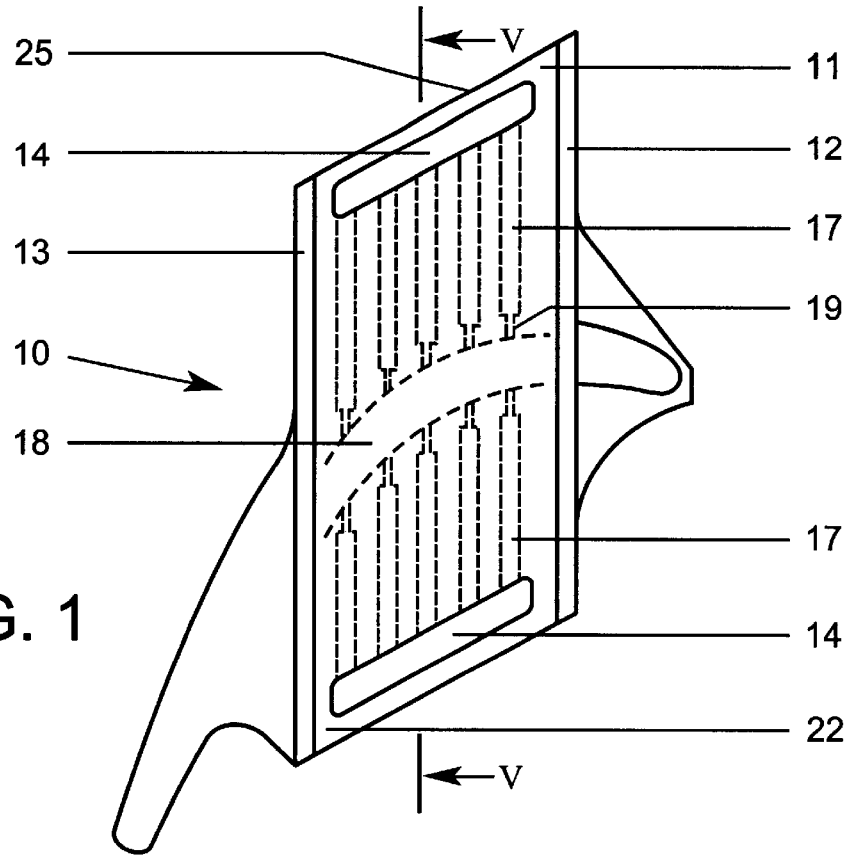
FIG. 1 shows a plan view of a preferred embodiment of the turbine blade with cooling bores discharging toward the top side of the shroud band
Figure 3:
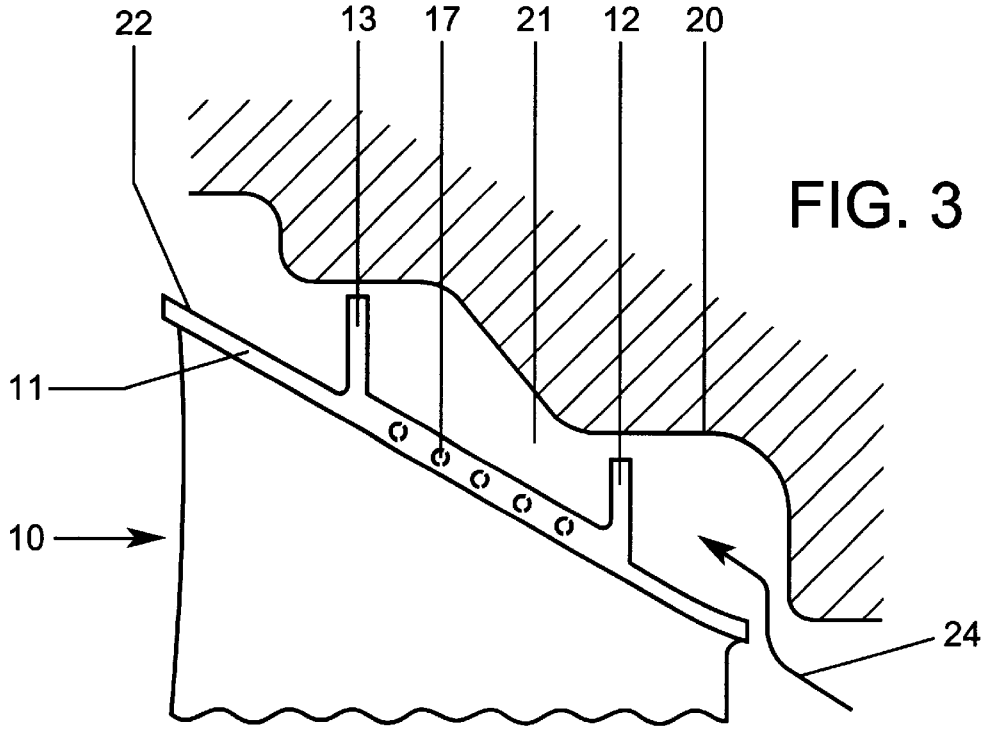
FIG. 3 shows a side view of the second modified form of the embodiment of FIG. 1 with cooling bores of circular cross section.

A preferred embodiment of a turbine blade according to the invention is shown in plan view in FIG. 1. The turbine blade 10 comprises the actual blade profile 23 and a shroud-band element 11, which is arranged at the blade tip transversely to the blade profile 23 and, together with the shroud-band elements of the other blades (not shown), produces a continuous, mechanically stabilizing shroud band. The blade profile 23 is partly hollow in the interior, and passing through the blade: profile 23 are one or more cooling-air passages 18, which direct cooling air from the blade root up to the blade tip. On its top side, the shroud-band element 11 has two sealing ribs 12 and 13, which run in parallel in the direction of movement of the blade tip and, together with the opposite casing wall 20 of the gas turbine, form a cavity 21 connected to the surrounding environment by gaps. In the interior of the shroud-band element 11, a plurality of cooling bores 17 run from the center outward between and essentially parallel to the ribs 12, 13. On the inlet side, the cooling bores 17 are connected to the cooling-air passage 18 and are supplied with cooling air from the latter. As can be seen from FIG. 1, the cooling bores 17 do not extend quite up to the lateral end or margin of the shroud-band element 11 but open in each case from the side into an elongated recess 14 sunk in the shroud-band element 11 on the top side 22. It goes without saying that, instead of a continuous recess 14, each of the cooling bores 17 taken by itself may also be connected to a separate recess. Furthermore, it is also conceivable for the cooling bores 17 to run at a slight angle and to deviate from an arrangement in parallel with one another, if this is necessary in order to optimize the cooling over the entire surface of the shroud-band element 11.

Furthermore, blow-out of the cooling air upward leads to an "inflation" of the cavity 21 between shroud-band and casing 20. This leads to an increase in the pressure in the cavity and thus helps to reduce the penetrating mass flow of hot gas 24. Furthermore, the mixing temperature in this region is of course also lowered, as a result of which the thermal loading of the shroud-band element 11 from the top side 22 is reduced.

Figure 2:
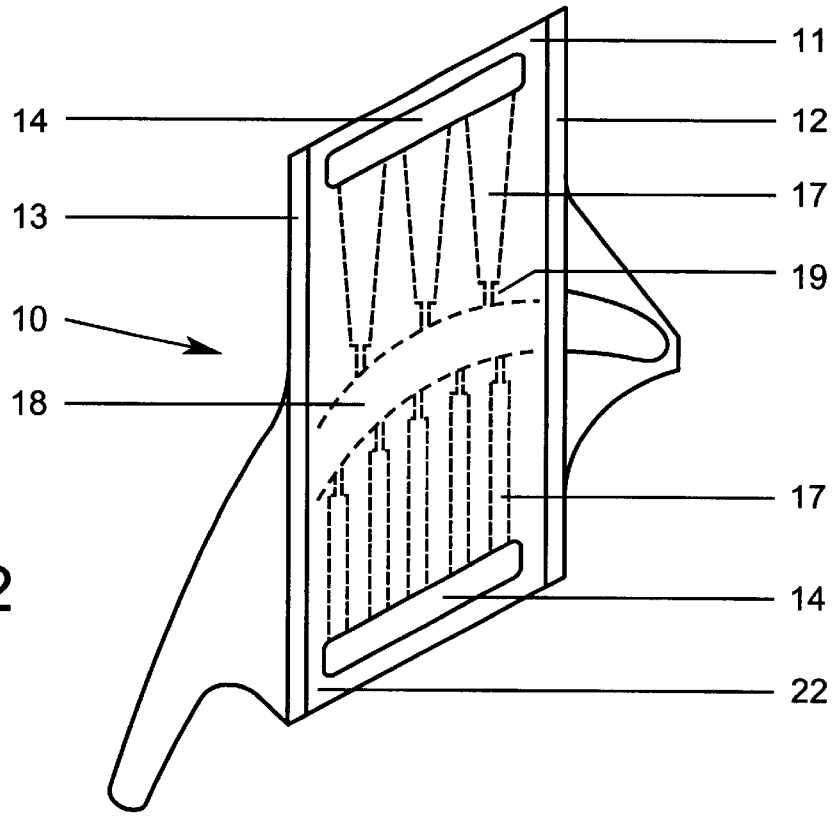
FIG. 2 shows a modified form of the embodiment of FIG. 1 with diffuser-like cooling bores
Figure 4:
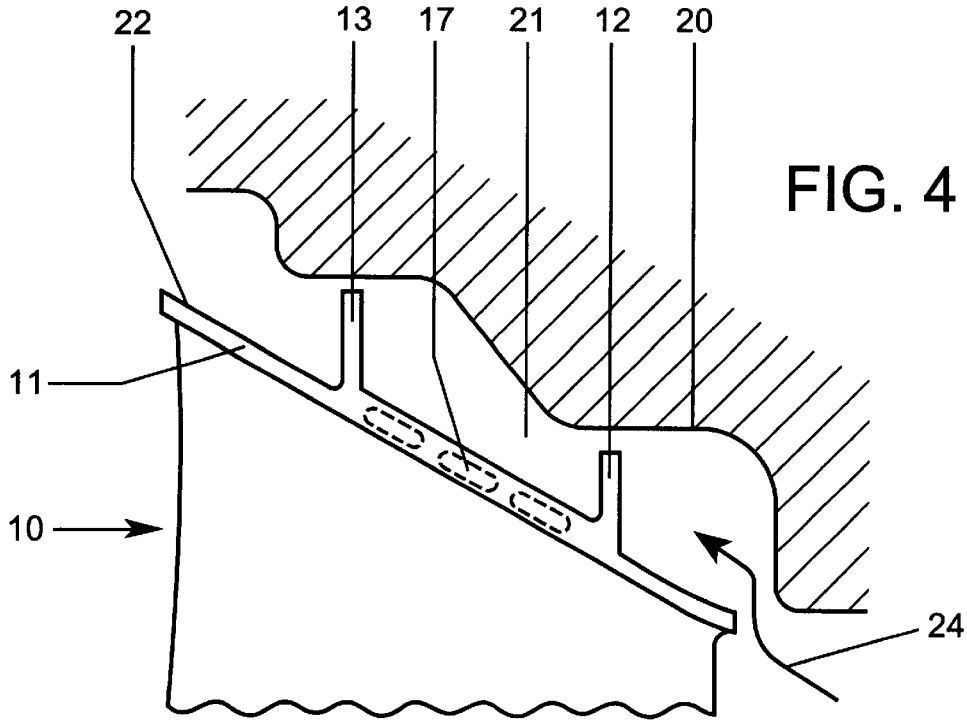
FIG. 4 shows a side view of a third modified form of the embodiment of FIG. 1 with cooling bores of oval cross section
Figure 5:
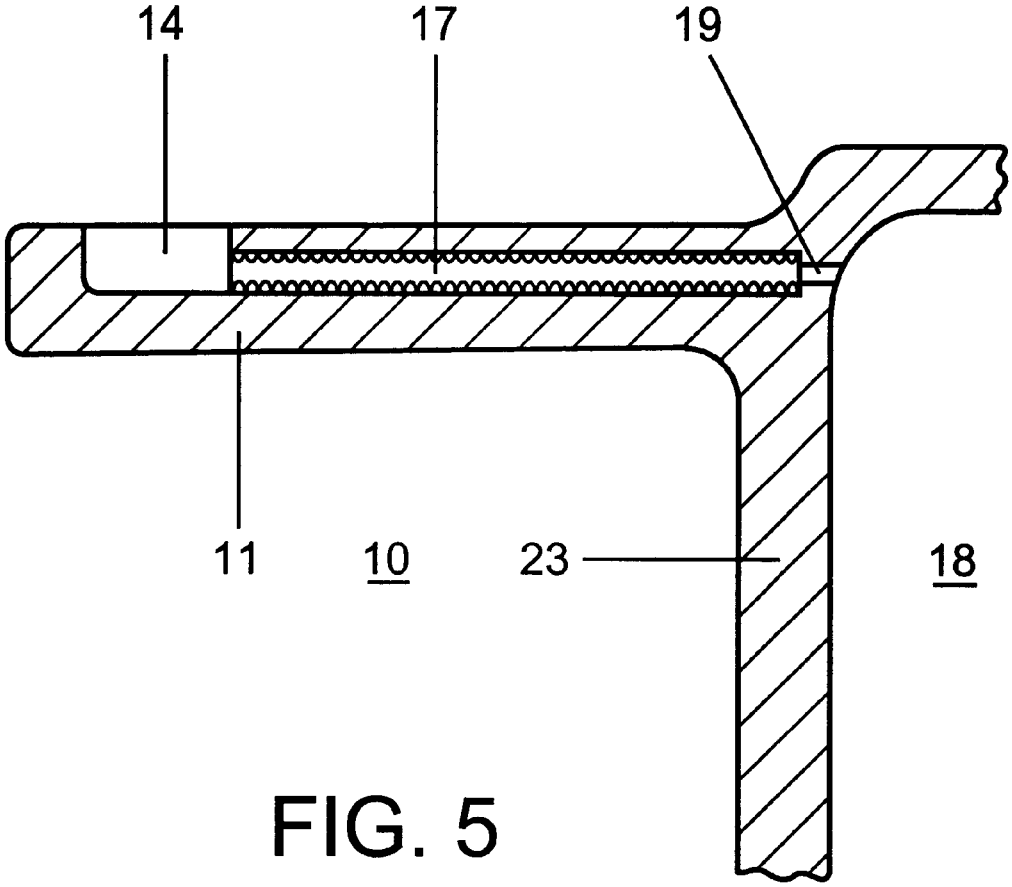
FIG. 5 shows a partial sectional view of a shroud-band element along the line 5—5 in FIG. 1

The cooling bores 17 in the cooling arrangement shown are preferably produced by the so-called STEM drilling method, which is fully described in detail in U.S. Pat. No. 5,306,401. As a result, it is possible (by varying the feed) to provide the surface of the cooling bores 17 with roughness features, ribs or turbulence points. This leads to markedly more efficient cooling, since the shape of the cooling bore can be optimized. Furthermore, it is advantageous to provide the cooling bores 17 with a choke point 19 in each case, preferably on the inlet side, i.e. in the region of the cooling-air supply at the profile 23. As a result, it becomes possible to deliberately limit the cooling-air mass flow and obtain markedly more efficient cooling. The embodiment according to FIG. 2 differs from that according to FIG. 1 in that the cooling bores 17, starting from the choke point 19, which is arranged in each case on the inlet side of each cooling bore, are designed as a diffuser or in a diffuser-like manner. In a further embodiment—shown in FIG. 4—the cooling bores have an oval configuration. Like the surface provided with inner roughness features or like the diffuser-like widening, this increases the effective surface available for the heat transfer. In addition or alternatively, the cooling bores 17 may have configurations different from those described above. Such configurations may be, for example, regularly or irregularly maintained recesses or undulations.

Figure 6:
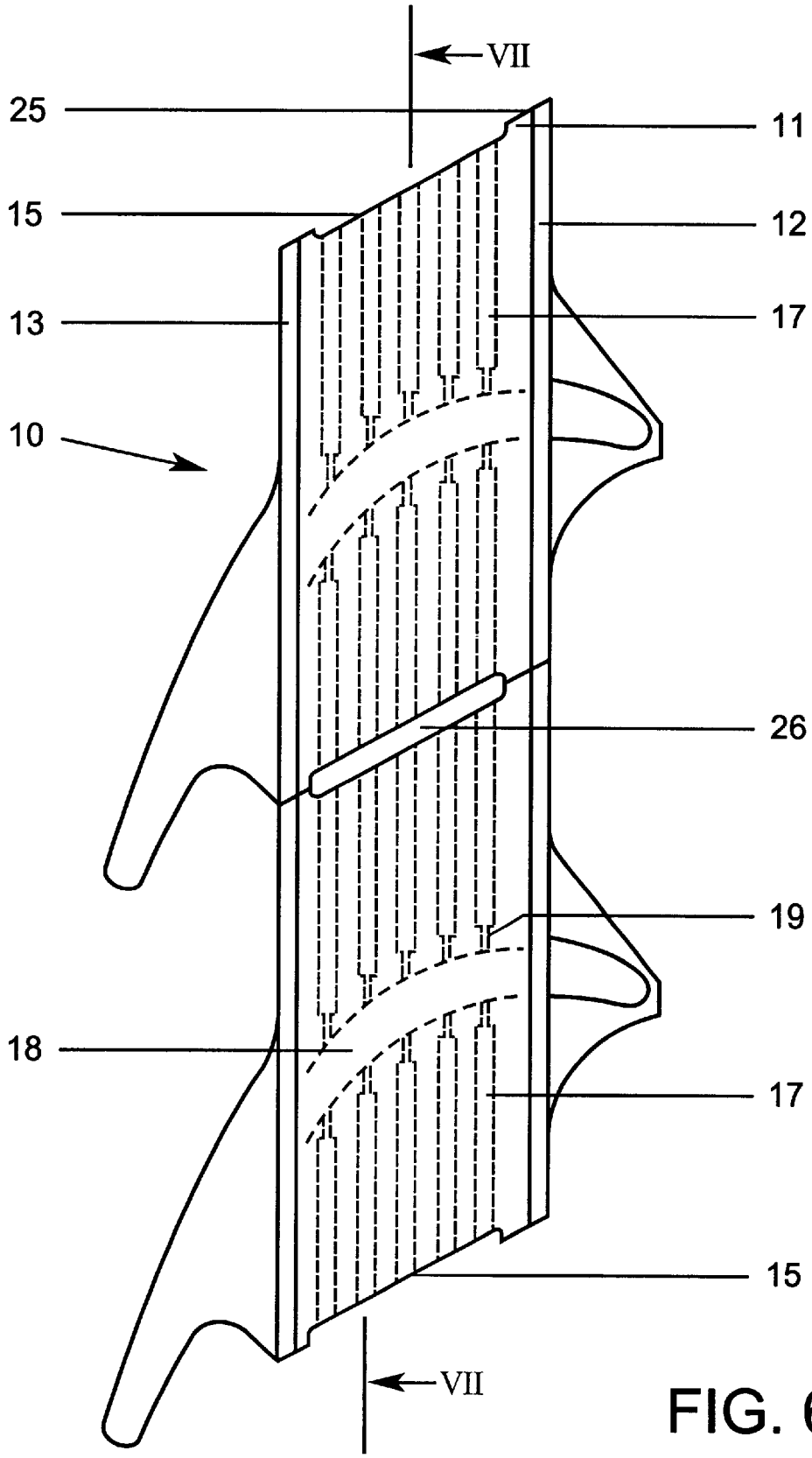
FIG. 6 shows a plan view of a fourth modified form of the embodiment of FIG. 1 having two shroud-band elements in with cooling bores discharging toward the side edge
Figure 7:
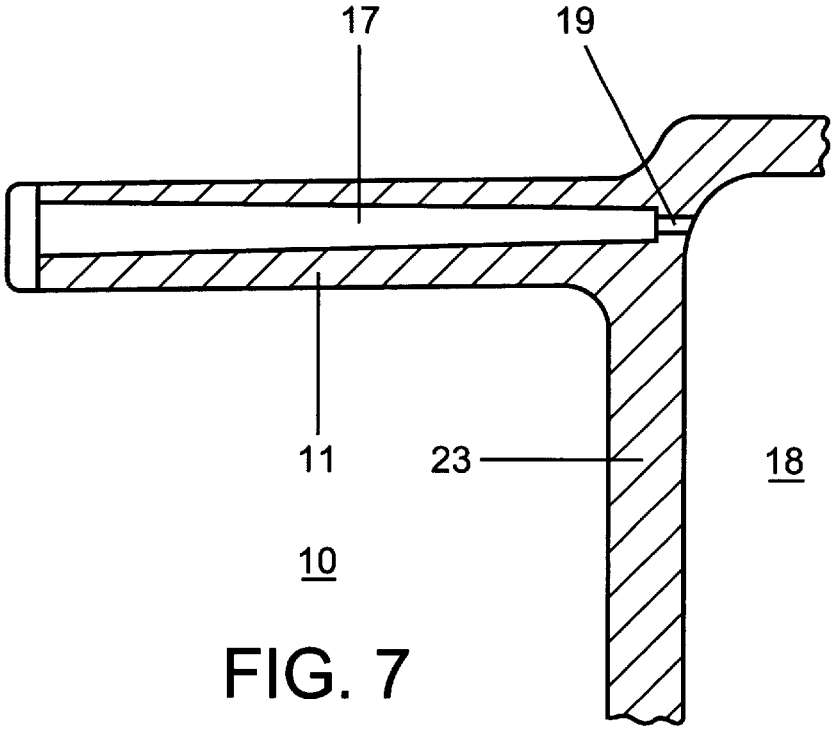
FIG. 7 shows a partial sectional view of a fifth modified form of the shroud-band element along the line 7—7 in FIG. 6

In a further favorable refinement of the invention according to FIGS. 6 and 7, the cooling bores 17 discharge at the side edge 25 of the shroud-band element 11. To avoid the disadvantages of the prior art, however, the side edges 25 of, the shroud-band elements 11 are designed such that adjacent elements 11 are only in contact zonally, whereas the region of the discharging cooling bores is set back in a recess 15. Between the adjacent elements, the opposite recesses 15 form gaps 26, into which the cooling air enters. This embodiment reliably prevents closure of the orifices by adjacent shroud-band elements. It ensures that the cooling air can always pass through the cooling bores 17, even if two adjacent shroud-band elements 11 are in mechanical contact. The cooling air entering the gap 26 from both adjacent elements 11 splits up into two partial flows. One partial flow flows upward and leads to inflation of the cavity 21 above the shroud band, whereas the other partial flow passes to the underside of the shroud band and mixes there with the hot gases. The mixing temperature which occurs reduces the thermal loading in this region. The volumetric ratio of the two partial flows can be influenced by the design of the gap. Thus the top side and under side may have a different gap width or the boundary walls may be inclined or designed differently from the fluidic point of view.

Figure 8:
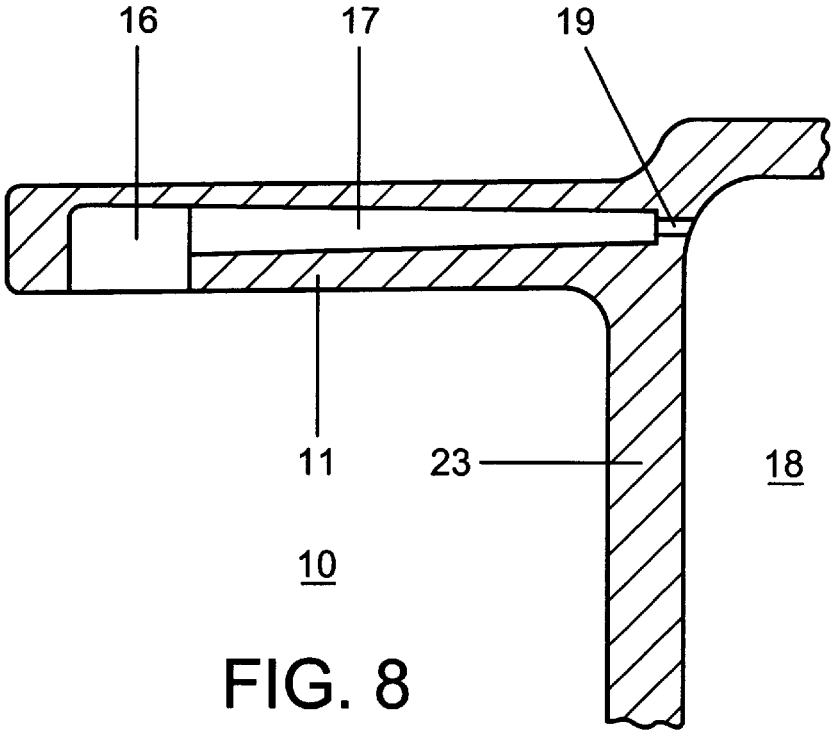
FIG. 8 shows a partial sectional view of a sixth modified form of the embodiment as in FIG. 7 of a shroud-band element with cooling air discharge toward the underside of the shroud-band element

FIG. 8 shows an embodiment with cooling-medium discharge on the underside of the shroud-band element. The cooling bores 17 open laterally into the recess 16. In this variant, the mixing temperature in the region of the underside of the shroud band is lowered and thus the thermal loading is reduced.

What is claimed is:

1. An air-cooled turbine blade which, at the blade tip, has a shroud-band element extending perpendicularly to the longitudinal axis of the blade, comprising a plurality of cooling bores passing through the shroud-band element for the purpose of cooling, the cooling bores being connected on the inlet side to at least one cooling-air passage running through the turbine blade to the blade tip and which cooling bores open on the outlet side into the exterior space surrounding the turbine blade, wherein the cooling bores extend from inside to outside in the shroud-band element and substantially parallel to the direction of movement of the blade, and the cooling bores open upstream of the outer margin of the shroud-band element directly into an elongated recess defined within the interior of the shroud-band element common to all cooling bores, which is open toward the exterior space.

2. The turbine blade as claimed in claim 1, wherein the exterior space is arranged on the top side of the shroud-band element and the cooling bores open laterally into the elongated recess.

3. The turbine blade as claimed in claim 1, wherein the elongated recess opens toward the exterior space and is located at the side edge of the shroud-band element.

4. The turbine blade as claimed in claim 1, wherein at least two spaced-apart sealing ribs running parallel to the direction of movement of the blade are provided on the top side of the shroud-band element thereby forming a cavity in interaction with a casing wall when the blade is mounted in a turbine opposite the casing wall.

5. The turbine blade as claimed in claim 4, wherein the cooling bores open into the space between the sealing ribs through the recess.

6. The turbine blade as claimed in claim 1, wherein at least two spaced apart sealing ribs are provided on the top side of the shroud-band element, and the cooling bores open into a gap formed by a recess, and at least one partial flow of the cooling air discharging from the gap flows into the space between the sealing ribs.

7. The turbine blade as claimed in claim 6, wherein the volumetric ratio of the partial flows discharging from the gap in the direction of the top side and underside of the shroud band is controlled by the gap geometry.

8. The turbine blade as claimed in claim 1, wherein the walls of the cooling bores have improved heat transfer rates produced by roughness features, ribs and/or turbulence points.

9. The turbine blade as claimed in claim 1, wherein the cooling bores are produced by means of the STEM drilling process.

10. The turbine blade as claimed in claim 1, wherein each of the cooling bores is provided with a choke point having a cross-sectional flow area that is less than the cross-sectional flow area through the rest of the cooling bore, and for limiting the cooling-air mass flow through the cooling bores.

11. The turbine blade as claimed in claim 10, wherein the choke points are each arranged on the inlet side of the cooling bores.

12. The turbine blade as claimed in claim 1, wherein the cooling bores have an oval cross section.

13. The turbine blade as claimed in claim 1, wherein the cooling bores form a diffuser or are of diffuser-like design in the direction of flow.

* * * * *